US011534696B2

(12) United States Patent
Steinman

(10) Patent No.: US 11,534,696 B2
(45) Date of Patent: Dec. 27, 2022

(54) WATER SLIDE

(71) Applicant: Global Pool Products, Bad Axe, MI (US)

(72) Inventor: Joshua Donald Steinman, Pigeon, MI (US)

(73) Assignee: Global Pool Products, Bad Axe, MI (US)

( * ) Notice: Subject to any disclaimer, the term of this patent is extended or adjusted under 35 U.S.C. 154(b) by 0 days.

(21) Appl. No.: 17/208,930

(22) Filed: Mar. 22, 2021

(65) Prior Publication Data

US 2021/0291064 A1 Sep. 23, 2021

Related U.S. Application Data

(60) Provisional application No. 63/082,603, filed on Sep. 24, 2020, provisional application No. 62/992,224, filed on Mar. 20, 2020.

(51) Int. Cl.
*A63G 21/18* (2006.01)
*A63G 31/00* (2006.01)

(52) U.S. Cl.
CPC ..... *A63G 21/18* (2013.01); *A63G 31/007* (2013.01)

(58) Field of Classification Search
CPC ..... A63G 21/00; A63G 21/18; A63G 31/007
USPC ..... 472/116, 117, 128
See application file for complete search history.

(56) References Cited

U.S. PATENT DOCUMENTS

| | | | | |
|---|---|---|---|---|
| 4,932,648 | A * | 6/1990 | Ahrens | A63G 21/00 104/70 |
| 5,478,281 | A * | 12/1995 | Forton | A63G 21/18 472/116 |
| 6,319,139 | B1 * | 11/2001 | Tracy | A63B 71/02 472/117 |
| 6,575,840 | B2 * | 6/2003 | Hagerty | A63G 21/18 472/116 |
| 11,198,071 | B2 * | 12/2021 | Svendsen | E04H 4/144 |
| 2006/0199464 | A1 * | 9/2006 | Ochi | G09F 13/24 446/167 |
| 2014/0213379 | A1 * | 7/2014 | Svendsen | A63G 21/18 472/117 |

* cited by examiner

*Primary Examiner* — Kien T Nguyen
(74) *Attorney, Agent, or Firm* — Mechanicus, P.L.L.C.

(57) ABSTRACT

A swimming pool slide comprising a pool slide shell and a slide flume formed in the shell to direct downhill sliding motion of a human rider. An interior water conduit transports water from a water source, through the slide shell to a top end of the flume. A slide shell base may be configured to allow for re-positioning of the slide to a proper/desired position relative to a pool edge after having connected the interior water conduit to a water source fixture in a pool deck. The slide may include a water stream shaper comprising a manifold that receives water from the conduit and re-shapes it into a sheet and redirects it onto the slide flume.

12 Claims, 11 Drawing Sheets

WATER SLIDE

CROSS-REFERENCES TO RELATED APPLICATIONS

This application claims priority in U.S. Provisional Patent Application Ser. Nos. 62/992,224 and 63/082,603 filed Mar. 20, 2020 and Sep. 24, 2020, respectively; and in U.S. Design Patent Applications 29/775,039; 29/775,040; 29/775,041; and 29/775,042; all filed Mar. 20, 2021.

BACKGROUND

Field

This application relates generally to a pool slide with water delivery.

Description of Related Art Including Information Disclosed Under 37 CFR 1.97 and 1.98

It's known for a water slide installed for use with a swimming pool to include a conduit that delivers water to the slide from a water source fixture installed in a pool deck a short distance from the pool. Installers are known to mistakenly position these water source fixtures in locations that preclude proper positioning of the slide relative to the pool edge. To compensate, a conduit (in the form of a hose or pipe) is connected between the water source fixture and the slide. This, undesirably results in an unsightly conduit running across the pool deck from the slide to the water source fixture. Some slides are known to include semi-recessed channels, or other aesthetic or practical accommodations intended to at least partially keep the conduit out of sight and out of the way of pedestrians. Inaccurate water source fixture positioning often requires that connecting water conduits to be routed out and away from the slide and across a pool deck rather than down along the channels as intended.

The positioning of known water slides on a pool deck cannot be significantly adjusted to compensate for a misplaced water source fixture because a pool slide must be installed on a pool deck at a safe distance from the pool edge as required to deliver riders reliably into the pool according to industry standards. In other words, slides currently on the market include water conduits that run at least partially external to the slide in order to reach poorly-placed water source fixtures. This results in exposed conduits running across pool decks, creating both aesthetic drawbacks, and tripping hazards.

SUMMARY

A swimming pool slide is provided, which comprises a pool slide shell, and a slide flume formed in the shell and configured to direct downhill sliding motion of a human rider from a top end of the slide flume to and past a bottom end of the slide flume. The slide also includes an interior water conduit configured to transport water through the slide shell to the top end of the slide flume from a water source fixture fixed in a pool deck.

Also provided is a swimming pool slide comprising a pool slide shell, and a slide flume formed in the shell and configured to direct downhill sliding motion of a human rider from a top end of the slide flume to and past a bottom end of the slide flume. The slide also includes a slide shell base configured to allow re-positioning of the slide to a proper/desired position relative to a pool edge after having connected an interior water conduit to a water source fixture fixed in a pool deck.

Also provided is a swimming pool slide comprising a pool slide shell and a slide flume formed in the shell and configured to direct downhill sliding motion of a human rider from a top end of the slide flume to and past a bottom end of the slide flume. A water conduit extends through an interior of the slide shell from a conduit lower end disposed adjacent a lower end of the slide shell, to a conduit upper end disposed adjacent an upper end of the slide flume. A water stream shaper is carried by the slide shell adjacent the upper end of the slide flume and comprises a manifold configured to receive a water stream through a manifold intake from the water conduit upper end, to re-shape the water stream into a sheet, and to redirect the water stream onto the slide flume through a manifold exit.

Also provided is a method for positioning a water slide on a pool deck and connecting the slide to a water source fixed in the pool deck. The method comprises the steps of: measuring water source fixture location error; using the water source location measurement data to configure a slide shell base of a slide shell of the water slide to allow an interior water conduit to receive water from the water source, through the slide shell base, when the slide shell base conceals the water source, and the slide is in a proper/desired position relative to a pool edge; connecting an interior water conduit of the water slide to the water source through the slide shell base; and placing the water slide over the water source in a position where the slide conceals the water source, and the slide is in a proper/desired position relative to a pool edge.

DRAWING DESCRIPTIONS

DETAILED DESCRIPTION

Figures 1, 2, 3:
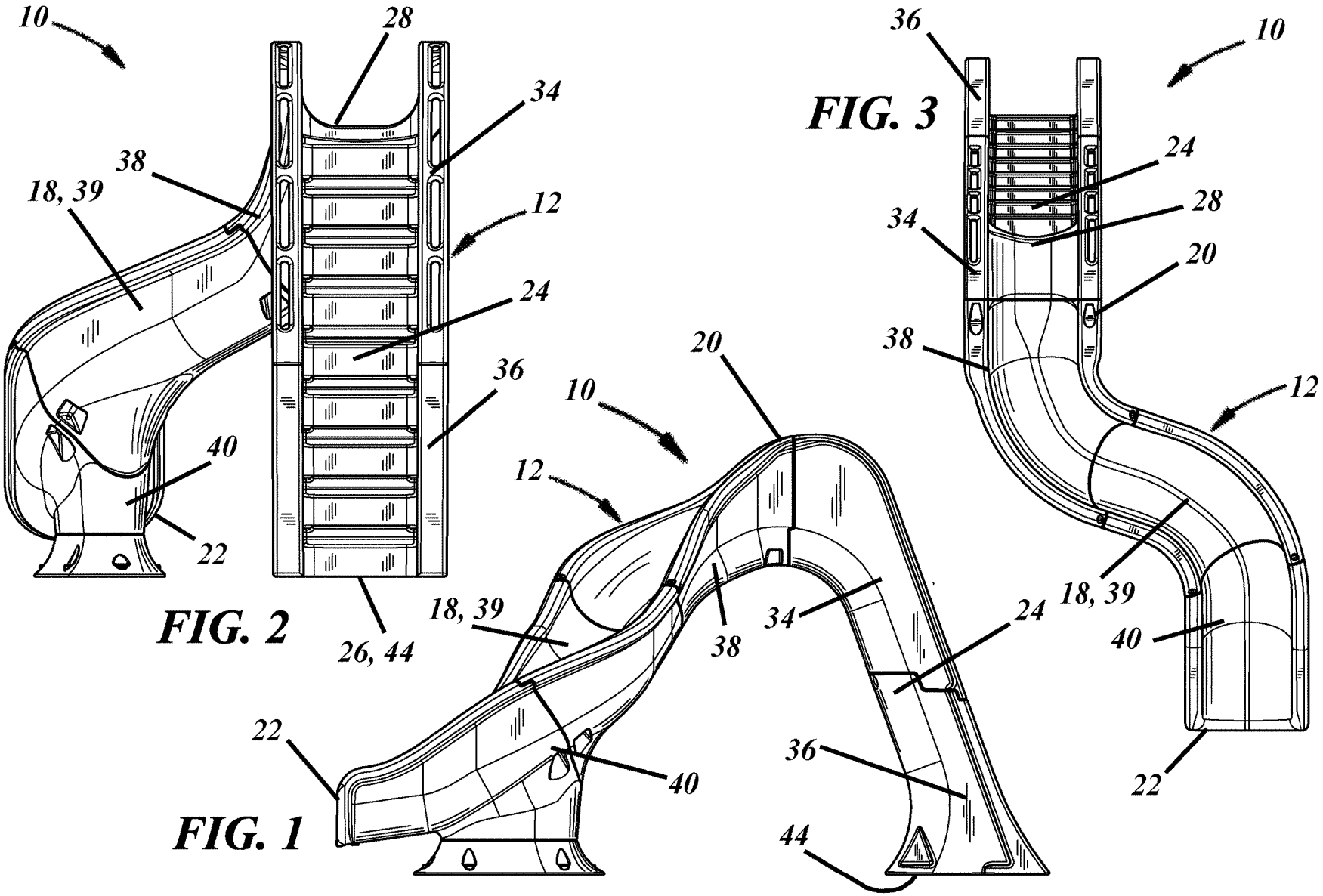
FIG. 1 is a right side elevational view of a first water slide embodiment.
FIG. 2 is a rear elevational view of the slide of FIG. 1.
FIG. 3 is a top plan view of the slide of FIG. 1.

Four embodiments of a swimming pool water slide are shown in the appended drawings. The first embodiment is generally shown at 10, the second embodiment at 10', the third at 10", and the fourth at 10'". Reference numerals with the designation prime (′), double-prime (″), and triple-prime (‴) indicate alternative configurations of elements of the respective second, third, and fourth embodiments, which also appear in the first embodiment. Unless indicated otherwise, where a portion of the following description uses a reference numeral to refer to a portion of the first embodiment, that portion of the description is intended to apply equally to elements designated by primed, double-primed, and triple-primed numerals in the second, third, and fourth embodiments, respectively. In other words, all description applied to a feature of the first embodiment also applies to all other features that share the same reference numeral in other embodiments unless the description states otherwise. For example, description applicable to the slide shell 12 in the first embodiment is intended to apply to the slide shells in the second (12'), third (12"), and fourth (12'") embodiments, except where variations in the slide shell are disclosed.

Figure 23:
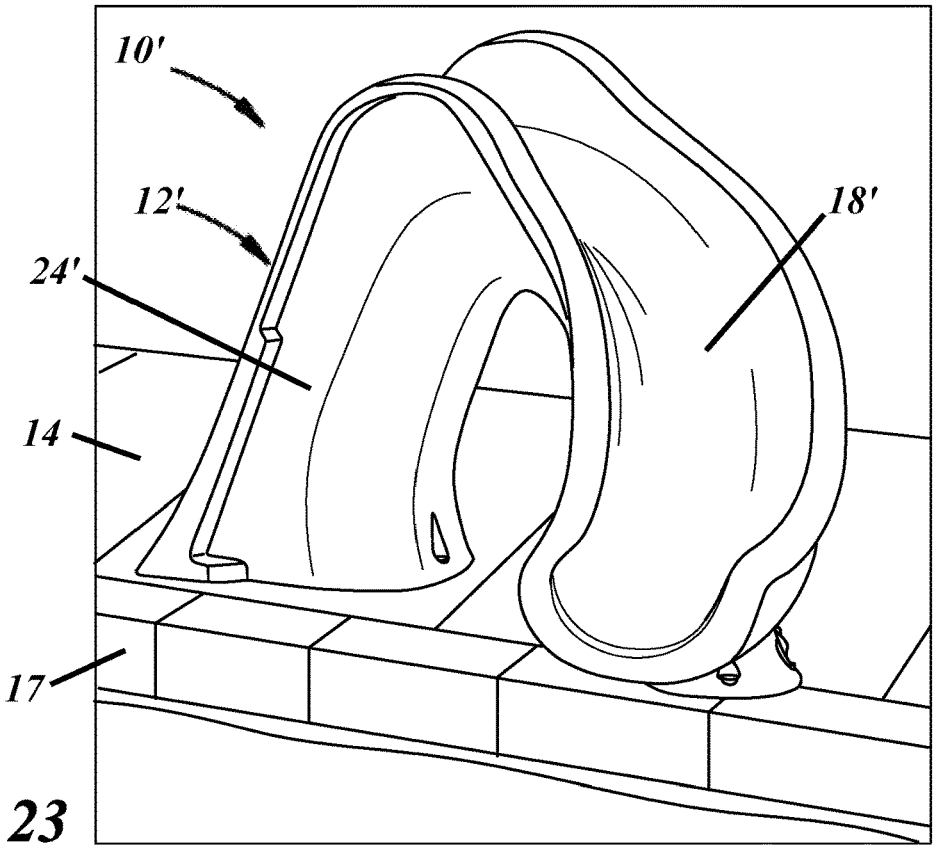
FIG. 23 is a simplified perspective view of the slide of FIG. 2, showing its positioning relative to a pool.

The slide 10 comprises a pool slide shell 12 configured to be supported on a pool deck 14 adjacent a swimming pool 16, as shown in FIG. 23. The slide 10 may be molded, or otherwise formed, from one or more pieces and may include a slide flume 18 formed in the shell 12 and configured to direct downhill sliding motion of a human rider from a top end 20 of the slide flume 18 to and past a bottom end 22 of the slide flume 18 and into the adjacent swimming pool 16. A ladder 24 may also be formed in the slide shell 12 and configured to allow a human rider to gain access to the slide flume top end 20 by climbing from a ladder bottom end 26 to a ladder top end 28 disposed adjacent the slide flume top end 20. An interior water conduit 30 is configured to transport water through the slide shell 12 to the flume top end 20 from a water source fixture 32 fixed in the pool deck 14.

Figures 4, 5, 6:
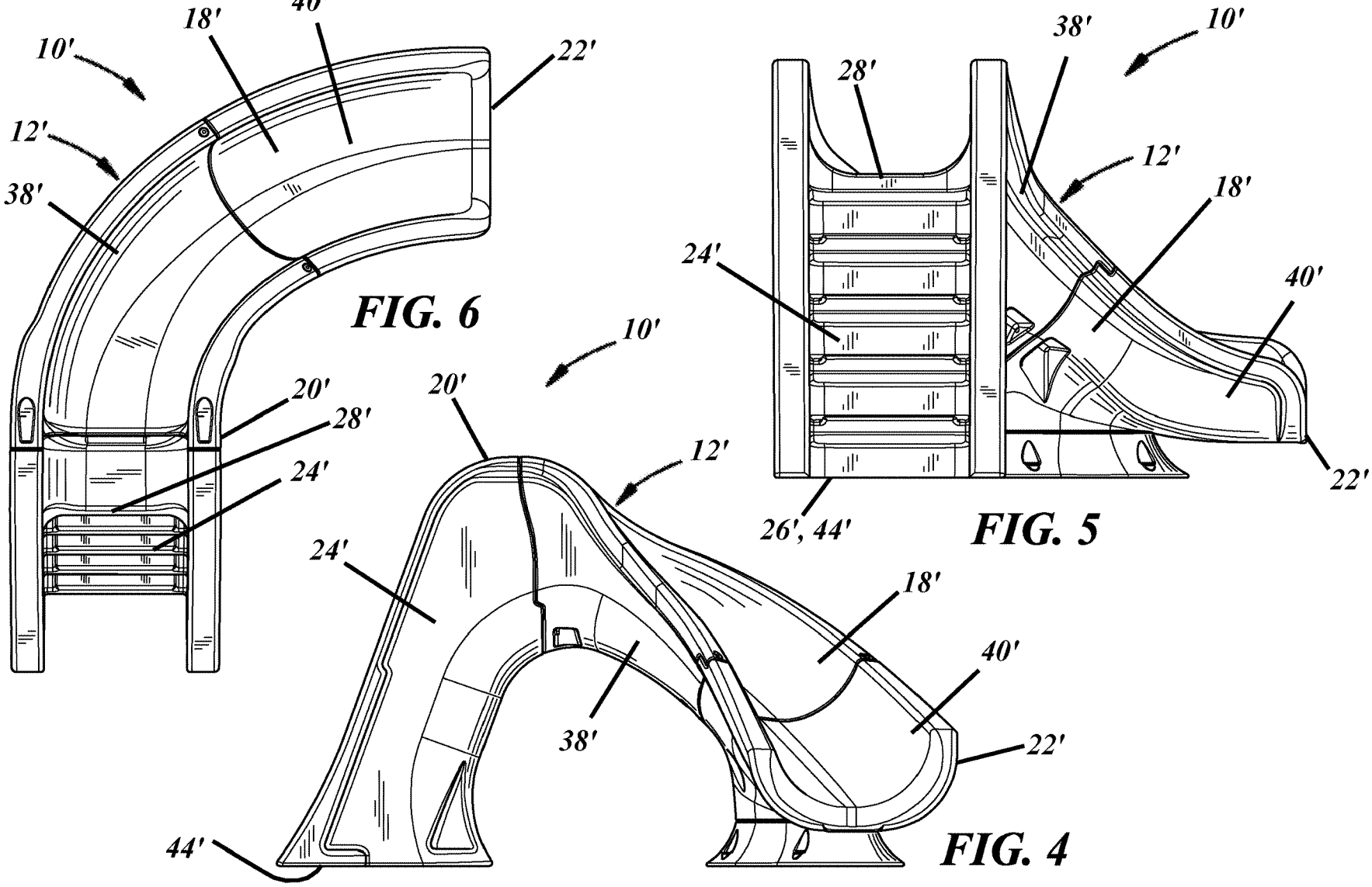
FIG. 4 is a left side elevational view of a second water slide embodiment.
FIG. 5 is a rear elevational view of the slide of FIG. 4.
FIG. 6 is a top plan view of the slide of FIG. 4.
Figures 7, 8, 9:
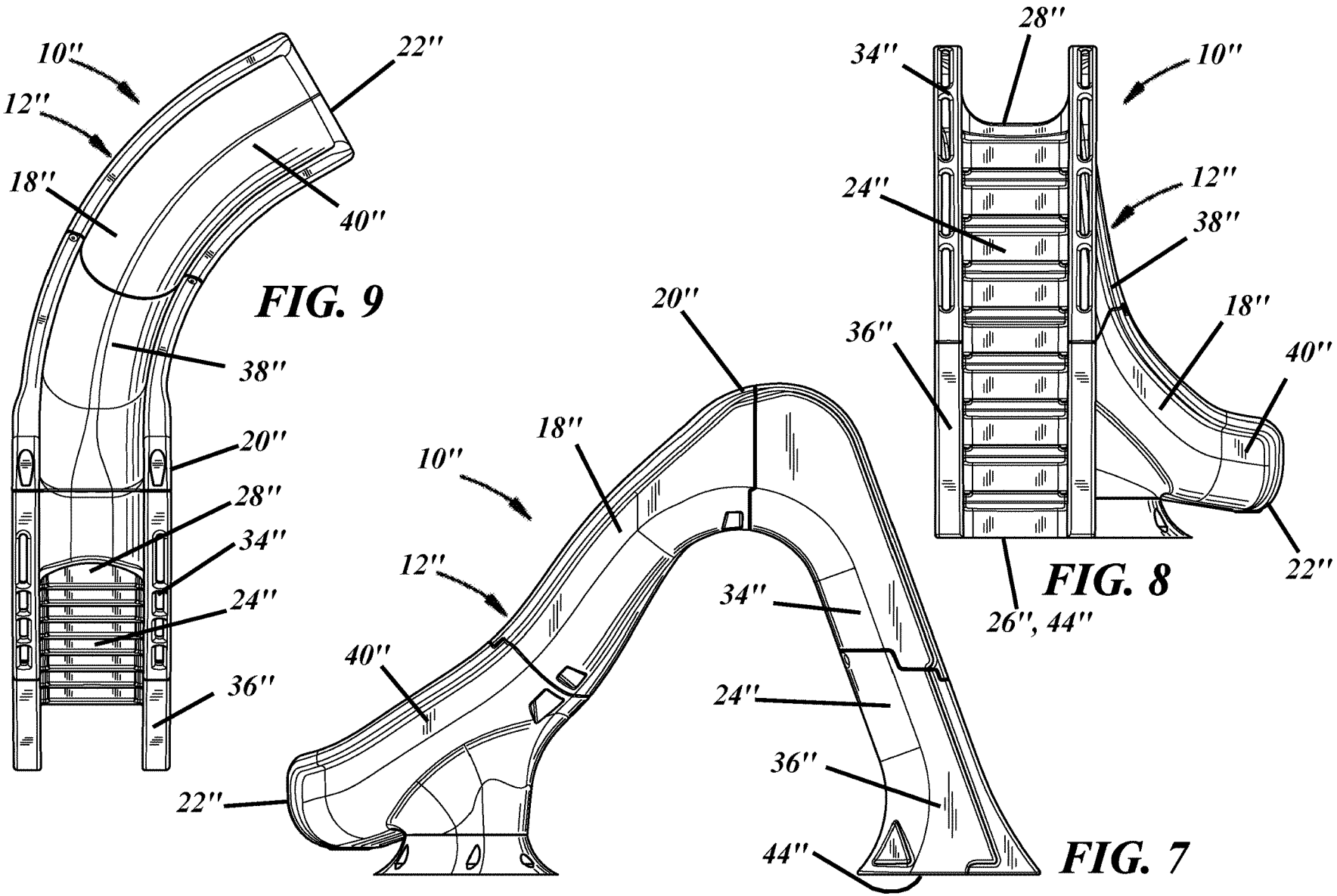
FIG. 7 is a ride side elevational view of a third water slide embodiment.
FIG. 8 is a rear elevational view of the slide of FIG. 7.
FIG. 9 is a top plan view of the slide of FIG. 7.
Figures 10, 11, 12:
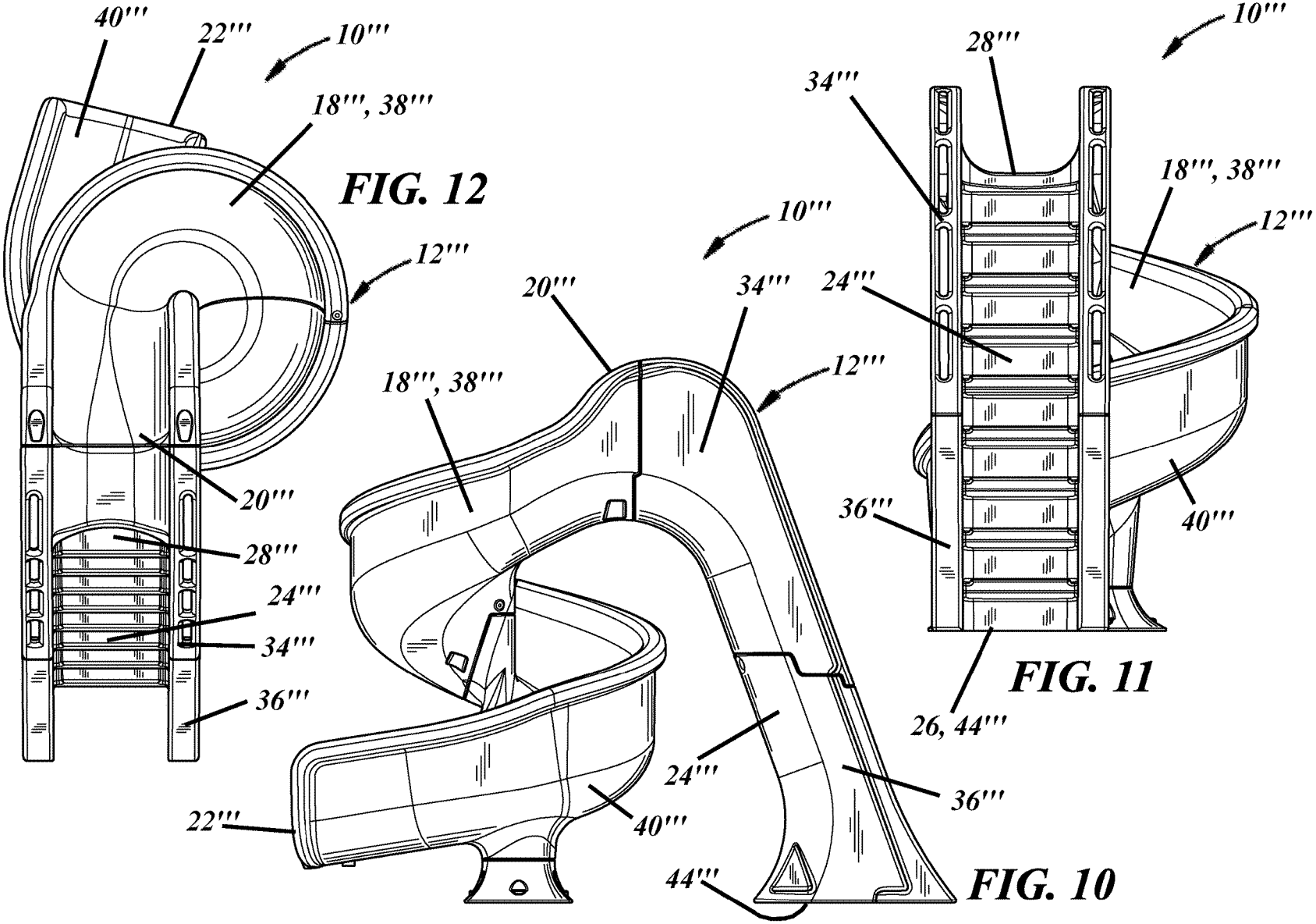
FIG. 10 is a right side elevational view of a fourth water slide embodiment.
FIG. 11 is a rear elevational view of the slide of FIG. 10.
FIG. 12 is a top plan view of the slide of FIG. 10.

The slide shell flume 18 and ladder 24 may be formed together in a single slide shell piece, or the flume 18 and ladder 24 may each be formed as a separate piece of the slide shell 12, or one or both of the flume 18 and ladder 24 may be formed from multiple slide shell pieces. For example, the slide shell 12'" of the embodiment shown in FIGS. 10-12 comprises upper 34'" and lower 36'" ladder pieces of the slide shell 12'" that are joined to a single-piece flume 18'", whereas the slide shell 12" of the embodiment shown in FIGS. 4-6 comprises upper 38" and lower 40" flume pieces of the slide shell 12" that are joined to a single-piece embodiment of the ladder 24". In comparison, the embodiment of FIGS. 1-3 comprises upper 38, middle 39, and lower 40 flume pieces joined to upper 34 and lower 36 ladder pieces.

Figure 13:
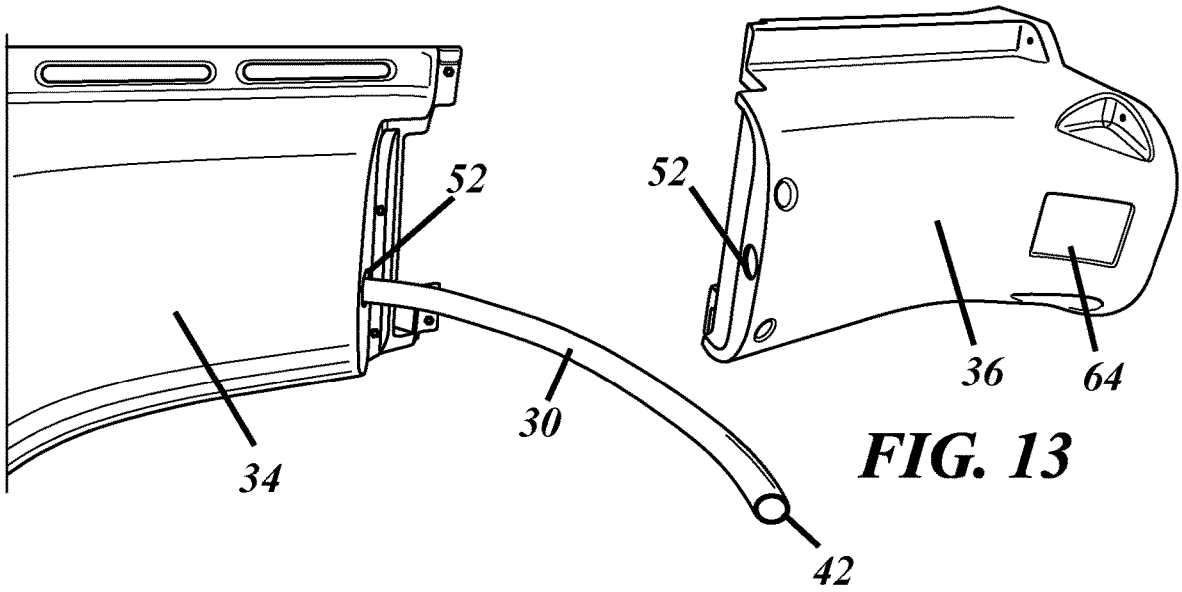
FIG. 13 is a front-right side perspective view of upper and lower ladder pieces of the slide of FIG. 1, shown separated to reveal a portion of a water conduit of the slide of FIG. 1.
Figure 14:
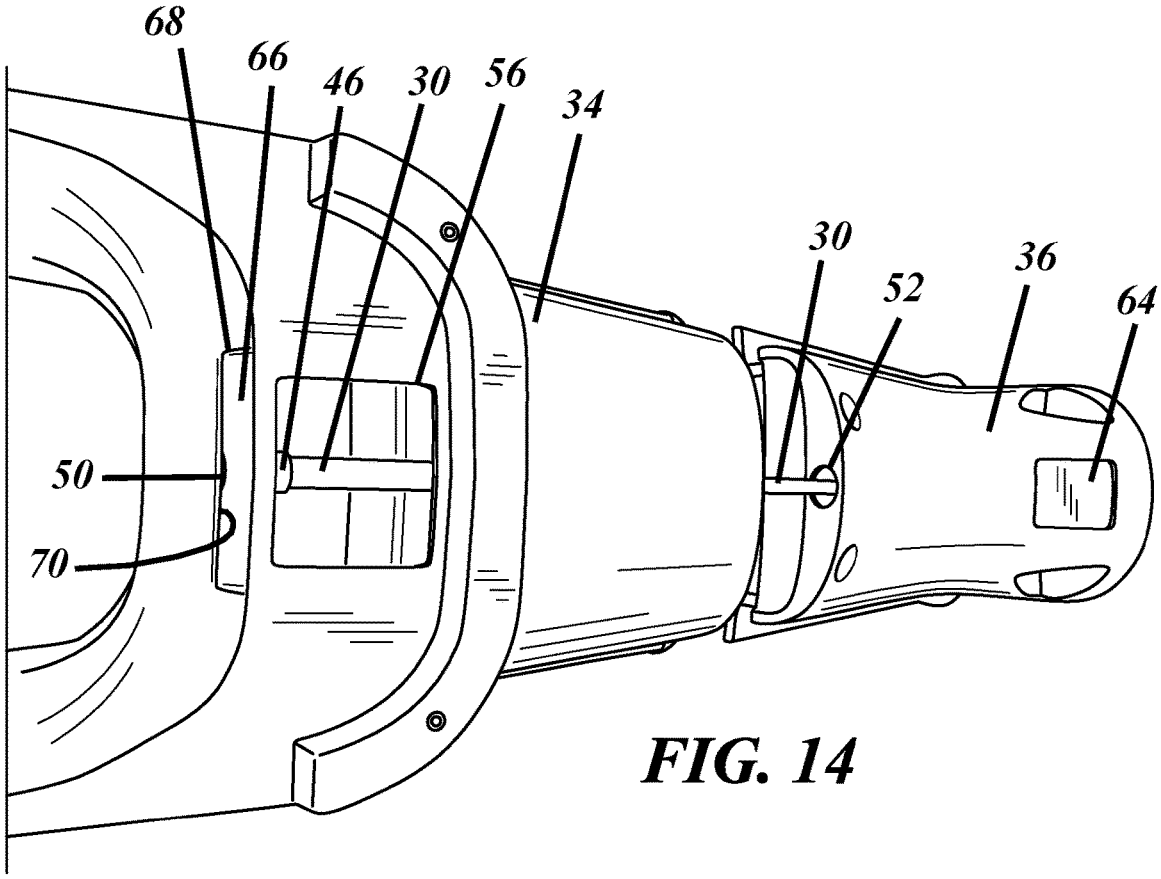
FIG. 14 is a top perspective view of the ladder pieces of FIG. 13, again shown separated to reveal the water conduit shown in FIG. 13, and also showing a water stream shaper feature of the invention at the top of the upper ladder piece.
Figure 15:
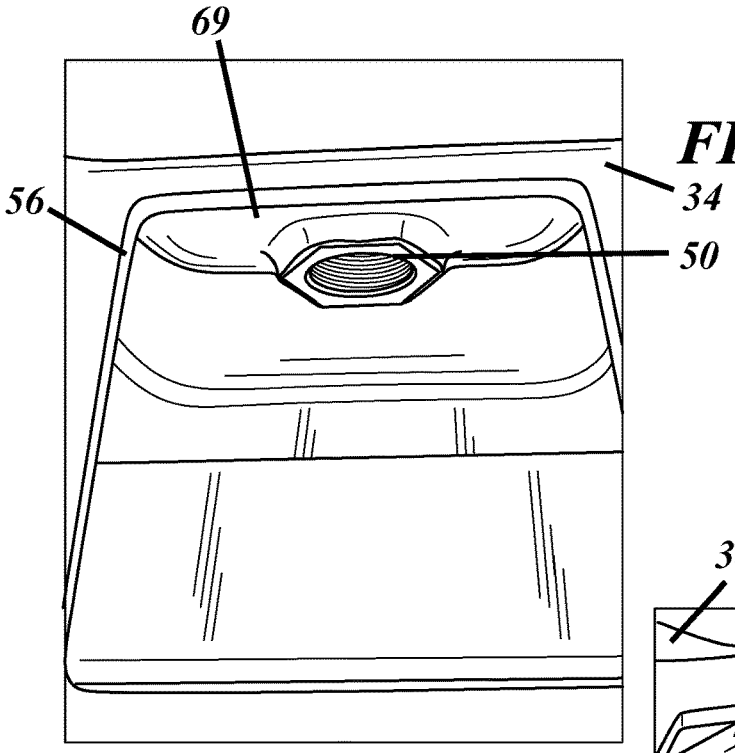
FIG. 15 is a magnified view of an underside of the water shaper feature showing a manifold intake.
Figure 16:
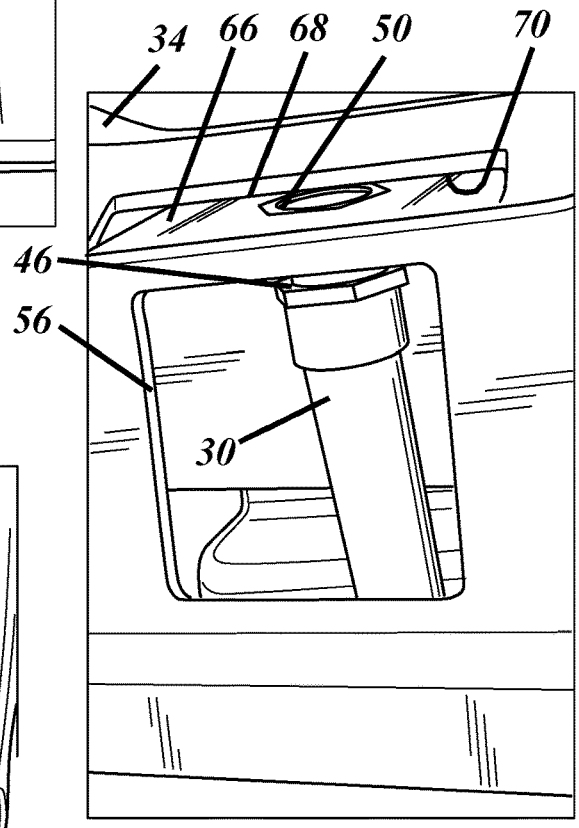
FIG. 16 is a magnified view of the water conduit of FIG. 13 connected to the manifold intake of the water shaper feature.
Figure 17:
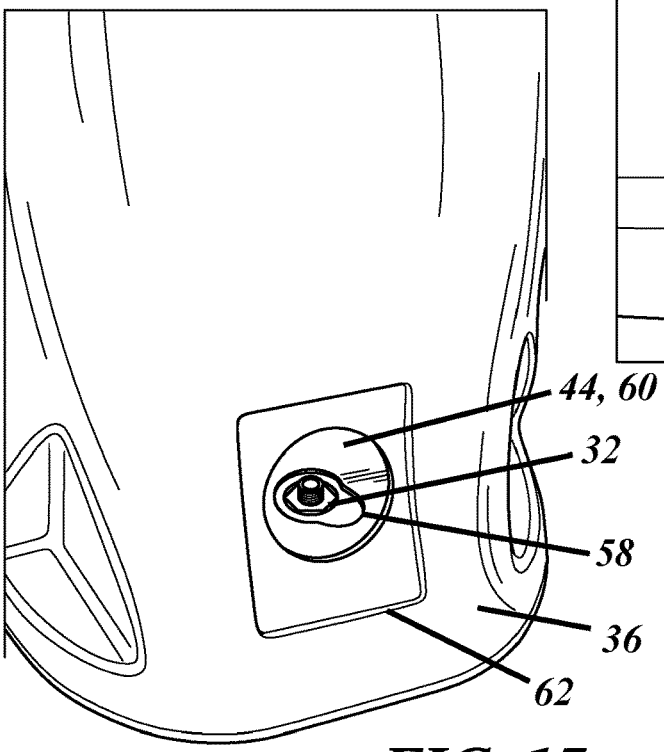
FIG. 17 is a front-left perspective view of the lower ladder piece of FIG. 13, with a water source fixture visible through a lower access port and base opening in the lower ladder piece, the base opening is shown having been adjusted in shape to align with an inconveniently-placed water source fixture.
Figure 18:
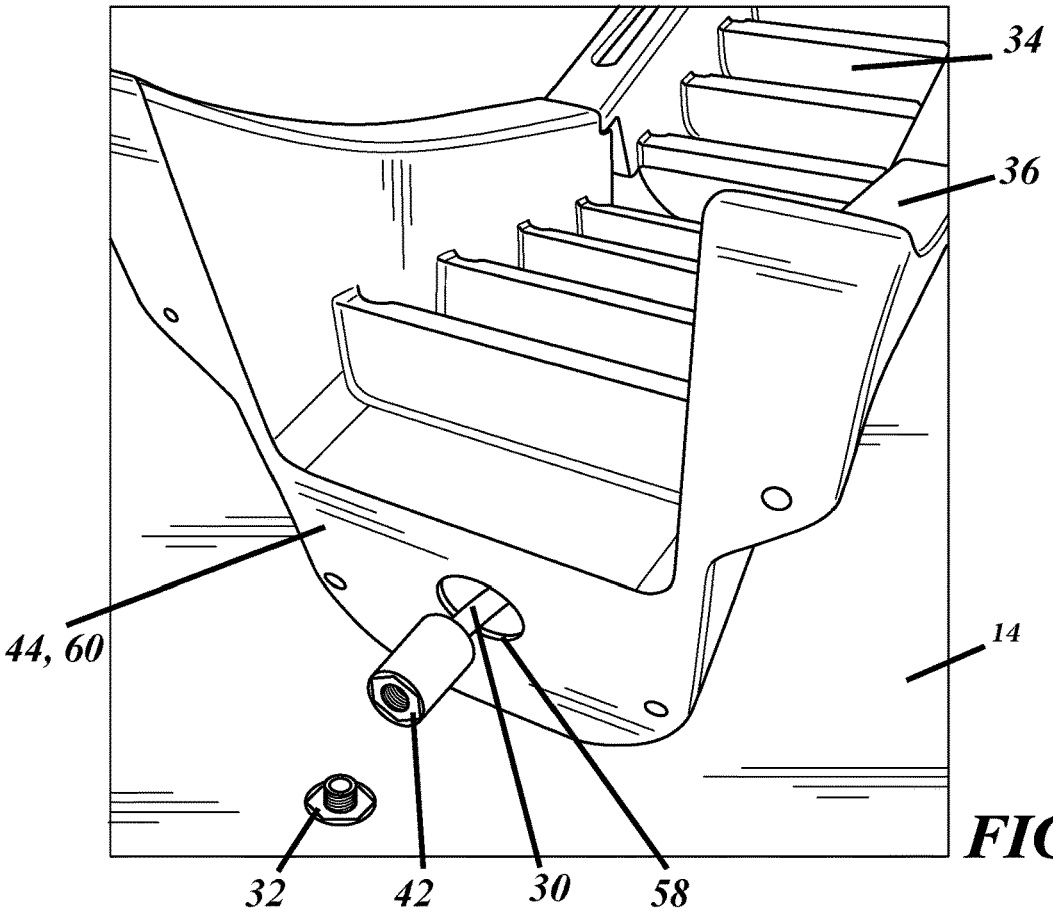
FIG. 18 is a bottom-rear-left side perspective view of a slide shell base of the slide of FIG. 1, with the conduit of FIG. 13 shown extending from the base opening of FIG. 17 (shown before adjustment)
Figure 19:
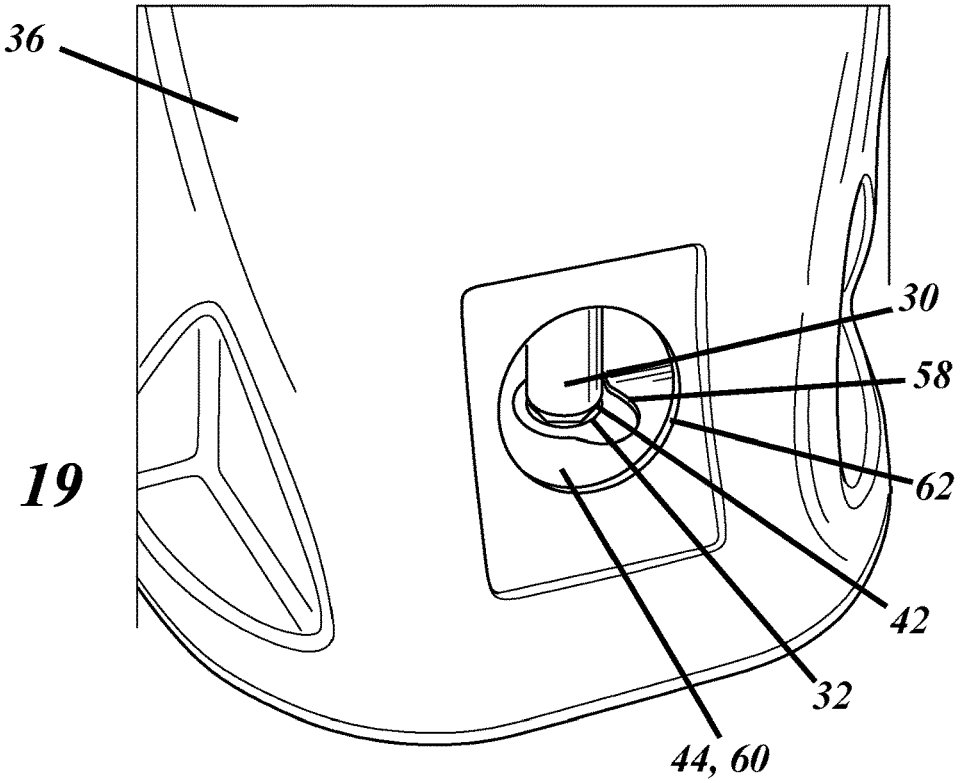
FIG. 19 is a front-left perspective view of a slide shell base of the slide of FIG. 1, with the conduit of FIG. 13 attached to the water source fixture of FIG. 17.

The water conduit 30 may extend through an interior of the slide shell 12 from a conduit lower end 42 disposed adjacent a base 44 of the slide shell 12 (as best shown in FIGS. 17-19) to a conduit upper end 46 which may be disposed adjacent and between the ladder top end 28 and the slide flume upper end 20 (as best shown in FIGS. 14-16). The water conduit upper end 46 may connect to a manifold intake 50 that is fixed to the slide shell 12 adjacent the slide flume top end 20. In embodiments having multiple ladder pieces 34, 36, and as best shown in FIGS. 13 and 14, the conduit 30 may pass from one ladder piece to another via ladder interface openings 52 located on the ladder pieces 34, 36 so that the ladder interface openings 52 will be at least partially aligned when the ladder pieces 34, 36 are assembled into ladder 24.

As shown in FIGS. 17-19 and 25, the water conduit 30 is configured to connect, at its lower end 42, to the water source 32, which may be fixed in the pool deck 14. And the slide shell base 44 may be configured to allow re-positioning of the slide 10 to a proper/desired position relative to an edge 17 of the pool 16 after having connected the interior water conduit 30 to the water source fixture 32 in the pool deck 14, and without having to run the water conduit 30 external to the base 44 in order to reach the water source fixture 32.

The slide shell 12 may comprise one or more access ports to allow easier adjustment and attachment/detachment of the water conduit 30. As shown in FIGS. 14-16, an upper access port 56 may be located on the upper ladder slide shell piece 34 adjacent the manifold intake 50, and positioned so that an installer can reach into the slide shell 12 to connect the conduit 30 to (or disconnect the conduit 30 from) the manifold intake 50. In this embodiment, the upper access port 56 is also positioned so that the upper access port 56 will be covered when the flume 18 (or at least one piece of the flume 18, depending on the embodiment) is attached to the ladder 24, thereby improving the aesthetics of the slide 10, preventing debris from entering the upper access port 56, and preventing tampering with the conduit upper end 46.

To allow adjustment in slide positioning, particularly in the case of a non-standard location of the water source 32, the slide shell base 44 may include a base opening 58 in a bottom wall 60 of the slide shell base 44. The base opening 58 may be positioned to receive the water source fixture 32 when the slide shell base 44 is positioned over the water source fixture 32, and the conduit 30 may be connected to the water source fixture 32 internally to the slide shell base 44. The slide shell base 44 may be configured (for example, by designing other areas of the slide 10 to relieve most of the slide shell base 44 of structural loads) such that a substantial portion of the bottom wall 60 of the base 44 can be cut away as necessary to form or enlarge the base opening 58 so that the base opening 58 may receive the water source fixture 32 and permit the internal conduit 30 to water source fixture 32 connection, without jeopardizing the structural integrity of the slide shell base 44. In this way, the slide 10 may be installed in a safe position and orientation relative to the pool edge 17, such that the slide 10 will be able to deliver riders safely past the pool edge 17 and into the pool 16, and will be positioned to do so even if the water source fixture 32 hasn't been installed precisely in its desired location, and without requiring the water conduit 30 to be run externally from the slide shell 12 to reach the water source fixture 32.

To assist in connecting and disconnecting the conduit 30 to and from the water source 32, a lower access port 62 may be located adjacent the slide shell base 44 as best shown in FIGS. 17 and 19. The lower access port 62 may be positioned to allow an installer to reach into the interior of the slide shell 12 to connect the conduit 30 to the water source 32, or to grab conduit 30 and direct it through the base opening 58 for later connection. The lower access port 62 may be covered by a panel 64, as shown in FIGS. 13 and 14, so that the conduit 30 remains hidden from outside view once the slide 10 is installed.

Figures 24, 25, 26:
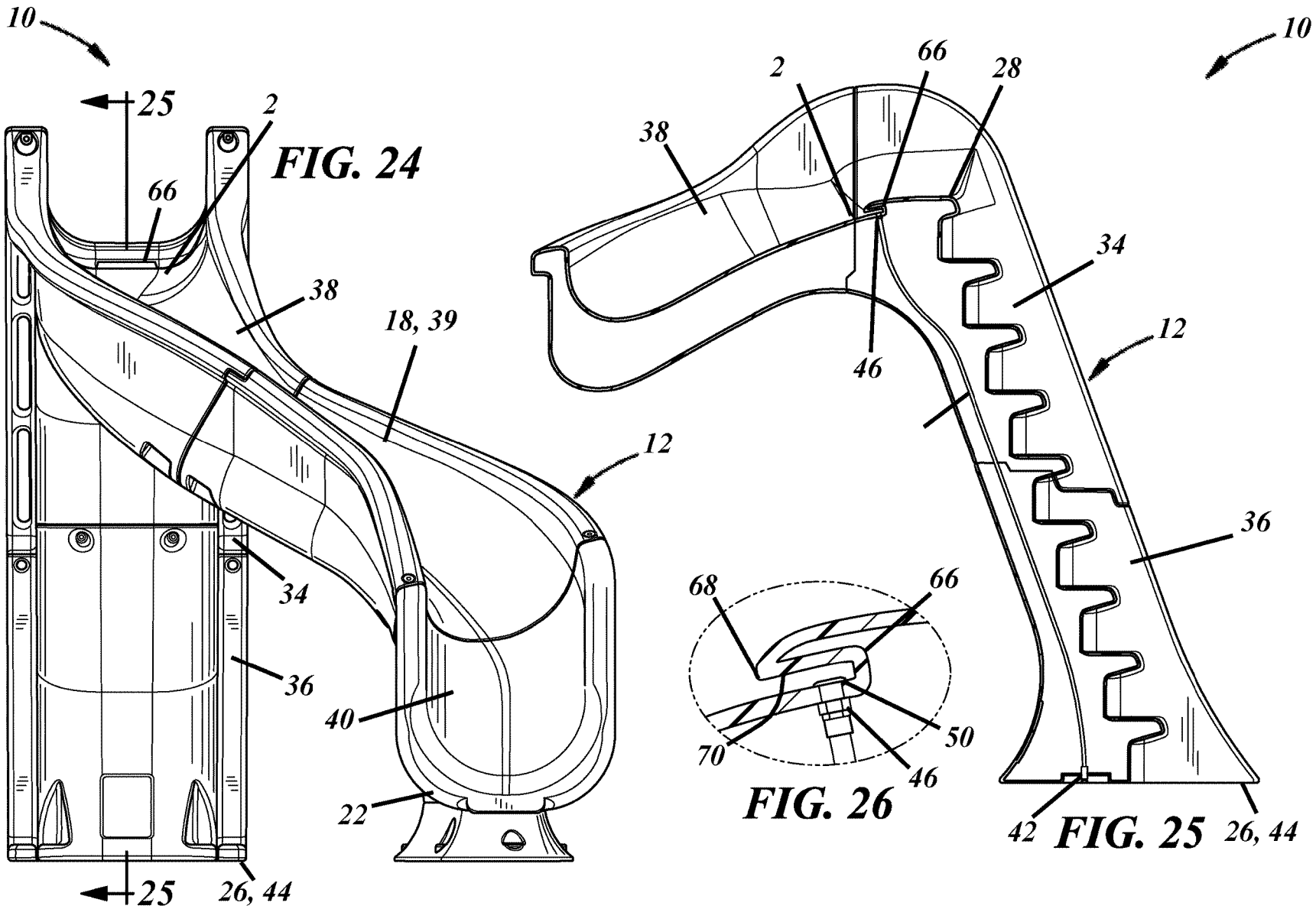
FIG. 24 is a front elevational view of the slide of FIG. 1.
FIG. 25 is a partial cross-sectional left elevational view of the slide of FIG. 1 showing routing of the water conduit through the slide.
FIG. 26 is a magnified view of an upper portion of FIG. 25.

To more evenly distribute water across the slide flume 18, and thereby avoid unwanted abrasion to a rider, a water stream shaper 66 may be carried by the slide shell 12 interiorly adjacent the flume upper end 20, as shown in FIGS. 24 and 25. The stream shaper 66 may comprise a manifold configured to receive a water stream through the manifold intake 50 from the water conduit upper end 46, to re-shape the water stream into a sheet, and to redirect the water stream onto the slide flume 18 through a manifold exit opening 68 in the slide shell 12. To better direct and form this sheet of water, the manifold 66 may widen outwardly in at least one dimension toward the manifold exit 68 (best shown by the contour of the underside 69 of the stream shaper manifold 66 visible in FIG. 15 through the upper access port 56), and the manifold 66 may include a water stream redirection surface 70 disposed in the path of, and at an approximate right angle to, the path a water stream would take as it enters the manifold 66 through the manifold intake 50. The pressure of the water impacting the redirection surface 70 and/or the widening manifold 66 (as well as the Coanda effect of the widening manifold's shape) will force the water stream to spread out, accelerate out of the manifold 66, and hold a generally smooth sheet-shape having a generally constant thickness across a transverse cross-section of the stream for some time after exiting the manifold 66.

Figure 20:
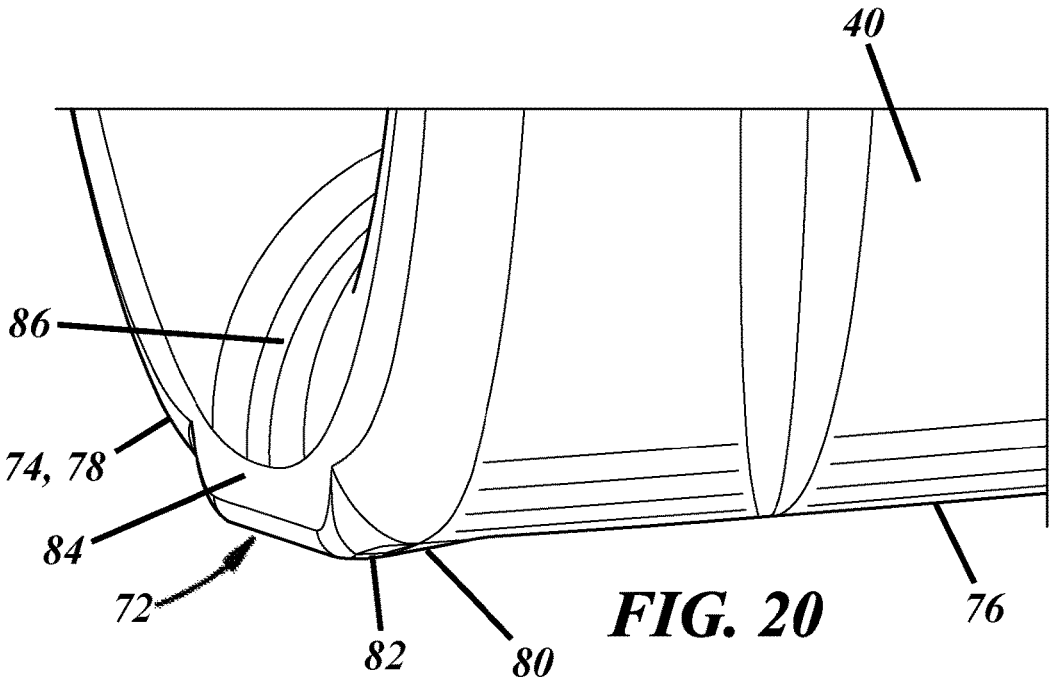
FIG. 20 is a magnified front-right perspective view of an anti-wicking feature at the exit end of a flume portion of the slide of FIG. 1.
Figure 21:
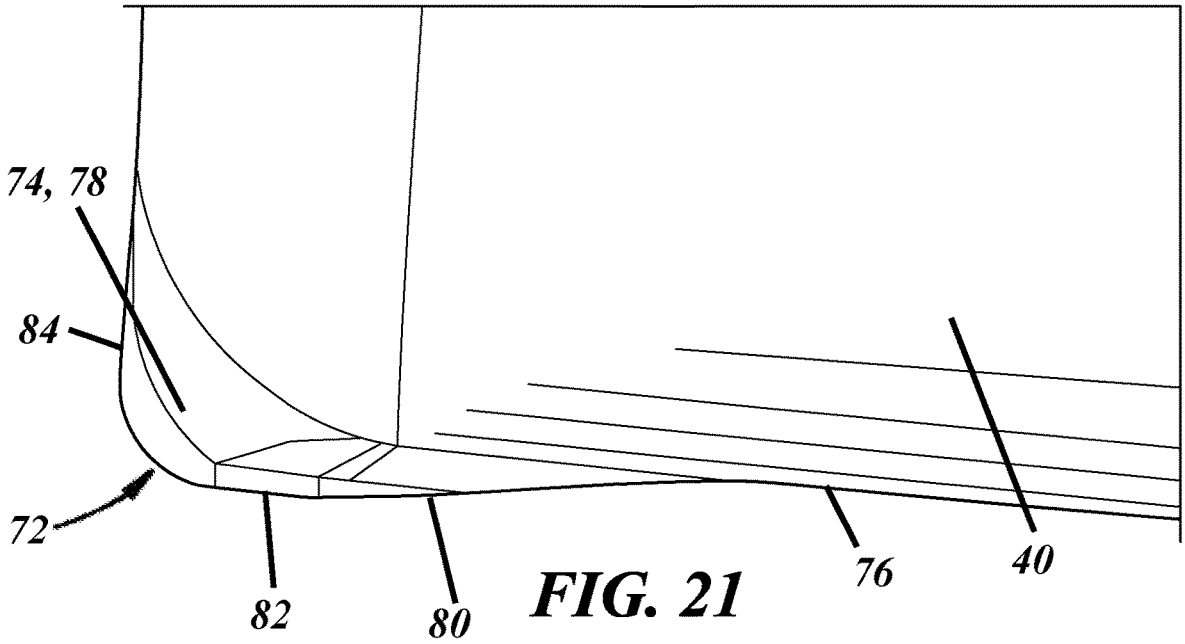
FIG. 21 is a magnified right side elevational view of the anti-wicking feature of FIG. 20.
Figure 22:
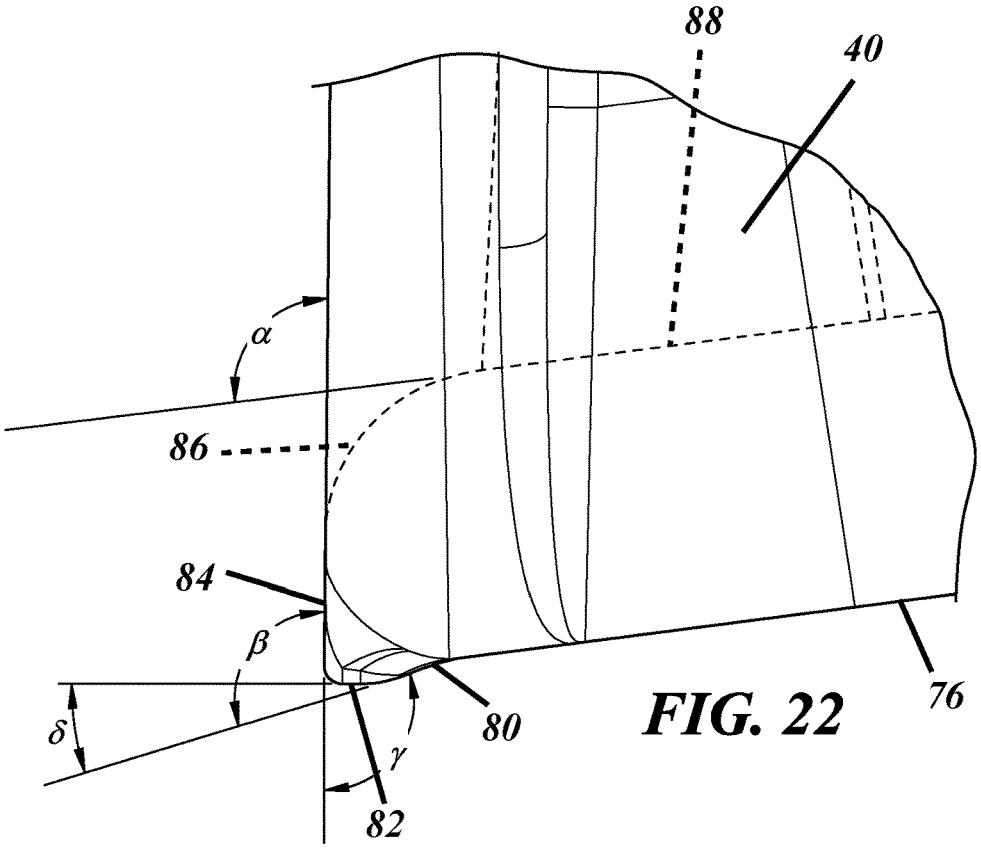
FIG. 22 is a magnified right side view of the anti-wicking feature of FIG. 20 showing internal flume contours.

An anti-wicking lip 72, best shown in FIGS. 20-22, may integrally extend from a rounded chin region 74 of the slide flume 18 under the flume lower end 22, adjacent where water is discharged from the flume 18. This anti-wicking lip 72 is shaped to prevent water that is exiting the flume 18 from adhering to the chin 74, running back along an underside 76 of the flume 18, and dripping or streaming onto the pool deck 14. Wicking, for purposes of this disclosure, is intended to refer to hydrodynamic effects, such as, but not limited to, adhesion, which cause some of the water exiting the flume 18 to flow back along the flume underside 76 rather than dropping into the pool 16. A preferred embodiment of the anti-wicking lip feature 72 may have a generally trapezoidal transverse cross-sectional shape, and, in profile, a generally curvilinear shape that may correspond to the shape of the chin region 74, but includes at least a portion that has a smaller surface radius than an adjacent portion 78 of the chin region 74, as best shown in FIG. 20.

A preferred embodiment of the anti-wicking lip 72 may comprise a lower transition lip surface 80 that diverges from the flume underside 76 at a steeper angle than the flume underside 76, a generally flat bottom lip surface 82 extending from the lower transition lip surface 80, a generally flat forward lip surface 84 extending from the bottom lip surface 82 at an approximately right angle to the bottom lip surface 82 adjacent the flume bottom end 22, and an upper flume transition surface 86 connecting an upper surface 88 of the flume 18 to the forward lip surface 84. As shown in FIG. 22, the lower transition lip surface 80 may connect to the bottom lip surface 82 at an angle $\delta$ of approximately 18.25 degrees. Where the lower transition lip surface 80 is curved, as shown in FIG. 22, the precise angle $\delta$ at the point of connection may be larger. The lower transition lip surface 80 may also be positioned at an angle $\beta/\gamma$ of approximately 108.25 degrees relative to vertical. The upper flume surface 88 may have an angle $\alpha$ of approximately 98.5 degrees relative to vertical where it joins the upper transition lip surface 86. The upper flume transition lip surface 86 may be curved with a radius of 2.5". And the forward lip surface 84 may transition to the bottom lip surface 82—where the two are joined—with a radius of 0.25".

Figure 27:
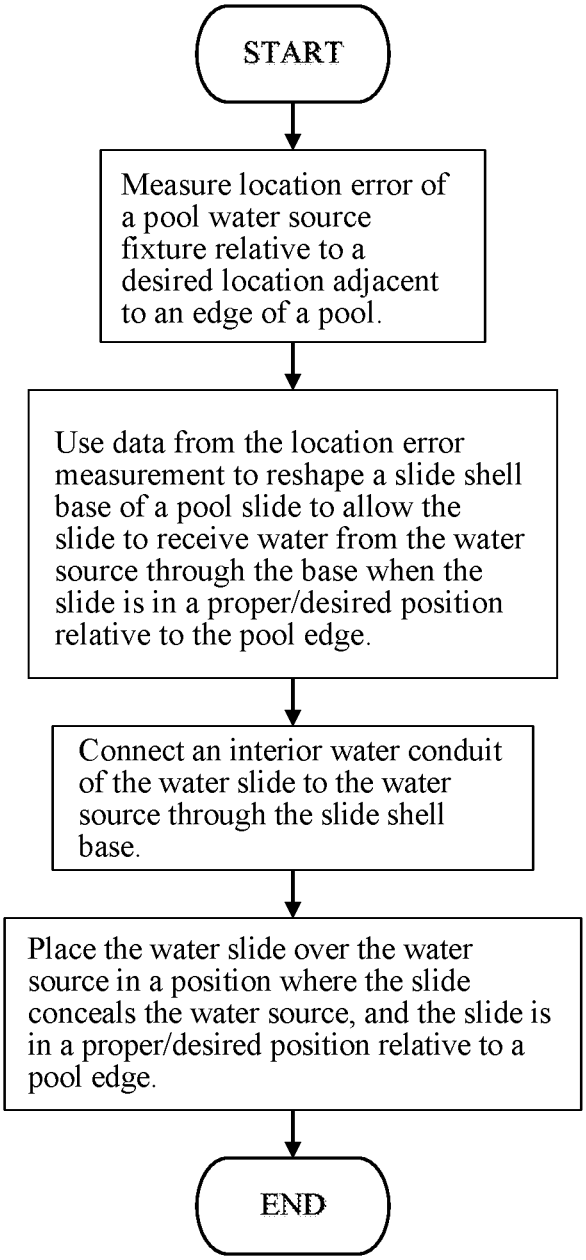
FIG. 27 is a flow chart showing a method for installing the slide adjacent a pool.

In practice, and as shown in FIG. 27, the water slide described above may be installed on a pool deck 14 according to the following steps:

First, at least one measurement may be taken of water source fixture location error, the location error being the extent to which the water source fixture 32 may have been improperly positioned in the pool deck 14 by installers. The water source fixture location error measurements may include both the distance between, and direction from, a desired location to the actual location of the installed water source fixture 32. Once the water source fixture location error measurements have been taken, they can be used to measure the direction and extent to which the base opening 58 in the bottom wall 60 of the slide shell base 44 of the water slide 10 needs to be created or enlarged and/or re-shaped to compensate for any improper water source 32 placement.

In other words, the slide shell base 44 may be configured to allow an interior water conduit 30 to be connected to and receive water from the water source fixture 32, with the slide shell base 44 positioned to conceal the water source 32 and support the slide in a proper/desired position relative to a pool edge 17. To accomplish this, the base opening 58 in the bottom wall 60 of the base 44 may be formed or adjusted in size and/or location so that the opening 58 receives the water source 32 when the slide base 44 is properly positioned relative to the pool edge 17.

With the base 44 so configured, the interior water conduit 30 may be connected to the water source 32 through the slide shell base 44. This connection can be made by, for example, connecting the conduit 30 to the water source 32 just before dropping the slide shell base 44 down over the water source fixture 32. Alternatively, the connection may be made after placement of the slide shell base 44 by using the lower access port 62 to make the connection.

This description, rather than describing limitations of an invention, only illustrates embodiments of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A swimming pool slide comprising;

a pool slide shell having a hollow interior portion and a slide shell base shaped to support at least a portion of the slide on a pool deck;

a slide flume formed in the shell and configured to direct downhill sliding motion of a human rider from a top end of the slide flume to and past a bottom end of the slide flume; and an interior water conduit extending from the slide shell base through at least part of the hollow interior portion of the slide shell to the top end of the slide flume and configured to transport water, from a water source fixture fixed in a pool deck through the slide shell from the slide shell base to the top end of the slide flume.

2. The swimming pool slide of claim 1 including an anti-wicking lip extending from a chin region of the slide flume and shaped to encourage water flowing out of the flume to separate from the flume at the chin region rather than running back from the chin region along an underside of the flume.

3. The swimming pool slide of claim 2 in which the anti-wicking lip comprises a lower transition lip surface that diverges from the underside of the flume at a steeper angle than the underside of the flume, a flat bottom lip surface extending from the lower transition lip surface, a flat forward lip surface extending from the bottom lip surface at a right angle to the bottom lip surface and parallel with a vertical flume exit surface, and an upper flume transition surface connecting an upper surface of the flume to the forward lip surface.

4. The swimming pool slide of claim 2 in which the interior water conduit is configured to transport water through an interior of a ladder piece of the slide shell to the top end of the slide flume from the water source fixture fixed in a pool deck.

5. The swimming pool slide of claim 1 in which the water conduit extends between separate openings in the slide shell.

6. A swimming pool slide comprising;

A pool slide shell;

a slide flume formed in the shell and configured to direct downhill sliding motion of a human rider from a top end of the slide flume to and past a bottom end of the slide flume;

an interior water conduit carried by and extending longitudinally to the top end of the slide flume though the slide shell from a slide shell base shaped to be placeable over and to cover a water source fixture fixed in a pool deck, and configured to allow re-positioning of the slide to a proper/desired position relative to a pool edge with the water source fixture remaining covered by the base and with the interior water conduit connected to the water source fixture.

7. A swimming pool slide comprising;

a pool slide shell;

a slide flume formed in the shell and configured to direct downhill sliding motion of a human rider from a top end of the slide flume to and past a bottom end of the slide flume;

a water conduit extending through an interior of the slide shell from a conduit lower end disposed adjacent a lower end of the slide shell, to a conduit upper end disposed adjacent an upper end of the slide flume; and a water stream shaper carried by the slide shell adjacent the upper end of the slide flume and comprising a manifold configured to receive a water stream through a manifold intake from the water conduit upper end, to re-shape the water stream into a sheet, and to redirect the water stream onto the slide flume through a manifold exit.

8. The water slide of claim 7 in which the manifold widens outwardly in at least one dimension toward the manifold exit.

9. The water slide of claim 8 in which the manifold includes a water stream redirection surface disposed in the path of, and at an approximate right angle to, the path of a water stream entering the manifold through the manifold intake.

10. A method for positioning a water slide on a pool deck and connecting the slide to a water source fixed in the pool deck, the method comprising the steps of:

measuring water source fixture location error;

using the water source location measurement data to configure a slide shell base of a slide shell of the water slide to allow longitudinally-extending interior water conduit to deliver, from the slide shell base to a top end of the slide, water received from the water source, with the slide shell base conceals the water source, and the slide is in a proper/desired position relative to a pool edge;

connecting an interior water conduit of the water slide to the water source through the slide shell base; and placing the water slide over the water source in a position where the slide concealing the water source and the interior water conduit, and the slide is in a proper/desired position relative to a pool edge.

11. The method of claim 10 in which the step of connecting the interior water conduit to the water source is performed after the step of placing the water slide over the water source; and the step of connecting the interior water conduit to the water source comprises connecting the water conduit to the water source by manipulating the water conduit via a lower access port located in the slide shell adjacent the slide shell base.

12. The method of claim 10 in which the step of connecting the interior water conduit to the water source is performed before the step of placing the water slide over the water source.

* * * * *